United States Patent [19]

Jahn

[11] Patent Number: 4,552,069

[45] Date of Patent: Nov. 12, 1985

[54] SMEAR-FREE TRANSFER CYLINDER FOR SHEET-FED ROTARY PRINTING MACHINES

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 637,846

[22] Filed: Aug. 6, 1984

[30] Foreign Application Priority Data

Aug. 6, 1983 [DE] Fed. Rep. of Germany ..... 3328451

[51] Int. Cl.[4] ..... B41F 13/08

[52] U.S. Cl. ..... 101/420; 29/121.1; 29/445; 29/451; 406/88

[58] Field of Search ..... 101/420, 422, 416 R, 101/416 A, 409, 246, 231, 230, 229; 271/276, 194, 195; 226/7, 97, 190; 406/88; 29/110, 121.1

[56] References Cited

U.S. PATENT DOCUMENTS

| | | | |
|---|---|---|---|
| 1,170,209 | 2/1916 | Wood | 101/420 X |
| 2,030,304 | 2/1936 | Knowlton | 101/420 X |
| 3,125,265 | 3/1964 | Warren et al. | 226/97 X |
| 3,542,358 | 11/1970 | Schuhmann | 101/420 X |
| 4,091,979 | 5/1978 | Browder | 226/7 |

*Primary Examiner*—Clifford D. Crowder

*Attorney, Agent, or Firm*—Herbert L. Lerner; Laurence A. Greenberg

[57] ABSTRACT

Smear-free transfer cylinder for sheet-fed rotary printing machines having a cylindrical casing formed with blow holes distributed over the entire sheet-carrying peripheral surface of the cylinder, includes air distribution elements respectively disposed in the blow holes for influencing blowing air flow out of the blow holes for forming a uniform air cushion, the air distribution elements being formed of air-permeable, elastic and slightly compressible material having a low specific gravity.

11 Claims, 8 Drawing Figures

28
29
27
7
30
17
31
10

SMEAR-FREE TRANSFER CYLINDER FOR SHEET-FED ROTARY PRINTING MACHINES

The invention relates to a smear-free transfer cylinder for sheet-fed rotary printing machines and, more particularly, to such machines wherein blow holes are formed in the cylinder casing distributed over the entire sheet-carrying periphery of the cylinder.

For transferring freshly printed sheets from one to the next printing units or from the last printing unit to the delivery of a printing machine, devices have become known heretofore wherein the sheet is supported by blowing air coming from the sheet guiding means during conveyance of the sheet, which is supposed to prevent a quality-impairing smearing or, in fact, wiping away of the still wet printing ink.

A device of this type is described in U.S. Pat. No. 3,542,358, according to which, in a delivery drum for sheet-fed printing machines, the sheets are forced away by air flows discharging from openings provided at the periphery of the drum, and, in order to distribute the discharging air more uniformly, the drum is entirely provided with a covering of conventional porous and air-permeable material. Control of the air discharge from the individual openings is afforded by an air control device which is both constructionally and economically costly. The air control device is located in the interior of the delivery drum, and is subject to great problems caused especially by partial and timed control, respectively, of the air precisely at the smear or slur-endangered locations of the freshly printed sheet. Apart from this, a great demand or requirement for blowing air always exists, which necessitates an unnecessarily large dimensioning or design for the system for generating the blowing air. Even only the most minute damage and soiling or fouling of the porous drum covering demand costly and time-consuming exchange or replacement thereof.

It is an object of the invention to provide a transfer cylinder with which slurring or smearing of freshly printed sheets is supposed to be reliably prevented.

It is another object of the invention to provide such a transfer cylinder which will ensure a smooth and completely flutter or wobble-free sheet transport, the sheet carrying air cushion produced therein being as free from turbulence as possible and without any pulsating jets.

It is a further object of the invention to provide such a transfer cylinder wherein the requirement or demand for blowing air is kept as low as possible so that the air blower generating the blowing air can be kept to as small dimensions as possible.

It is an added object of the invention to provide such a transfer cylinder which is service or maintenance-friendly, and wherein the air distribution elements are relatively easily exchangeable or replaceable.

It is an additional object of the invention to provide such a transfer cylinder wherein no time-consuming adjustments of mechanical sheet carriers is required.

It is yet another object of the invention to provide such a transfer cylinder, the cost of manufacture of which is kept at a minimum, any controls-engineering expense for air metering being avoided.

With the foregoing and other objects in view, there is provided in accordance with the invention, a smear-free transfer cylinder for sheet-fed rotary printing machines having a cylindrical casing formed with blow holes distributed over the entire sheet-carrying peripheral surface of the cylinder, comprising air distribution elements respectively disposed in the blow holes for influencing blowing air flow out of the blow holes for forming a uniform air cushion, the air distribution elements being formed of air-permeable, elastic and slightly compressible material having a low specific gravity.

The structural distribution of a multiplicity of individual air distribution elements over the entire periphery of the cylinder permits an especially reliable, smooth and smear-free sheet transport. Because the flow conditions or relationships required for forming a closed, turbulence and pulse jet-free air cushion is able to be determined relatively simply in an empirical manner by the selection of the material as well as the shape of the individual sheet carriers and thereby also varying factors in the printing process, such as processing a different paper thickness, for example, can be taken into consideration as rapidly as possible, optimization of an especially stable sheet transport or conveyance is possible. Due to the relatively easy exchangeability of individual, for example, soiled or fouled air distribution elements, the greatest possible service or maintenance-friendliness and, accordingly, operational reliability of the transfer cylinder is furthermore assured.

The possibility of utilizing materials of varying air permeability for the sheet carriers permits an exact matching of the air cushion of the transfer cylinder, by means of skillful choice of material, to the processing of paper of varying weights, one being able, respectively, to do with a minimum of blowing air and consequently use an air blower of relatively small dimensions.

In accordance with another feature of the invention which affords an especially simple and economical mass production, the air distribution elements are formed of chemically stiffened or hardened fleece and/or curled chemical fibers. The air distribution elements of fleece or fiber mats are thereby able to be stamped or punched out relatively easily in large quantities, so that the manufacturing costs thereof with respect to those of the remaining transfer cylinder are insignificant. The fine structuring of the hair network of the fleece or chemical fibers has an effect like a multiplicity of air channels and thereby ensures a reduction in pressure and very effective comminution or atomization of the blowing air which is diffused in all directions, whereby an especially smooth sheet conveyance with optimal support of the sheet in spite of minimal contact of the sheet is assured.

In accordance with a further feature of the invention, the air distribution elements are formed of a two-component compound synthetic material having a lower region formed of reversibly deformably foam material and an upper region formed of a material selected from the group consisting of chemically stiffened fleece and curled chemical fibers. This has the advantage that a multiplicity of conventional commercial foam-material sponges and mats, such as are used for industry or household cleaning purposes, can serve for producing the air distribution elements. while the great elasticity of the foam material assures a very reliable indirectly locking seat in the blow holes, the sheet proper is uniformly carried by a multiplicity of individual fleece hairs and fiber ends, respectively, with very slight area contact in primarily punctiform contact zones.

In accordance with an added feature of the invention, and for the purpose of improving the retension of the air distribution elements in the cylinder casing so as to increase the operational reliability, the air distribution elements have a respective diameter greater to such an extent than that of the respective blow holes so that the air distribution elements are retained in inserted condition in the blow holes due to elastic tension thereof.

In accordance with an additional feature of the invention, the air distribution elements are formed at least at one end thereof with a supporting collar with which the air distribution elements are braced, in inserted condition thereof in said blow holes, at least against an inner edge of the cylinder. Due to this feature, the seating of the air distribution elements in the cylinder casing can be formed more reliably by positive-locking reinforcement, in order to have an opposing effect, on the one hand, on the centrifugal forces action upon the air distribution elements or, on the other hand, due to the compressive loadings and tensile forces, respectively, caused by the sheet.

In accordance with yet another feature of the invention, and so that the operating radius of the blowing air discharging from the individual air distributors becomes greater and a regular covering and chaining together, respectively, of the individual air outlets occur for the purpose of forming a coherent air cushion, both the blow holes and the air distribution elements appertaining thereto widen conically towards the surface of the cylinder.

In accordance with yet a further feature of the invention, and in order to prevent any contact, even if very slight, between the individual air distribution elements and the freshly printed underside of the sheet, the air distribution elements project maximally to the surface of the cylinder.

In accordance with yet a further feature of the invention, the air distribution elements are formed of hydrophilic material.

In accordance with yet an additional feature of the invention, the air distribution elements are disposed in the blow holes in a positively locked manner contingent upon the shape thereof.

In accordance with yet an added feature of the invention, the air distribution elements project slightly beyond the surface of the cylinder.

In accordance with another aspect of the invention there is provided a method of producing a smear-free transfer cylinder for sheet-fed rotary printing machines having a cylindrical casing formed with blow holes distributed over the entire sheet-carrying peripheral surface of the cylinder, air distribution elements respectively disposed in the blow holes for forming a uniform air cushion which comprises forming the air distribution elements of air permeable, elastic and slightly compressible material having a low specific gravity, and shaving the air distribution elements so as to adjust them in the blow holes in an inserted condition thereof.

Other features which are considered as characteristic for the invention are set forth in the appended claims.

Although the invention is illustrated and described herein as embodied in smear-free transfer cylinder for sheet-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
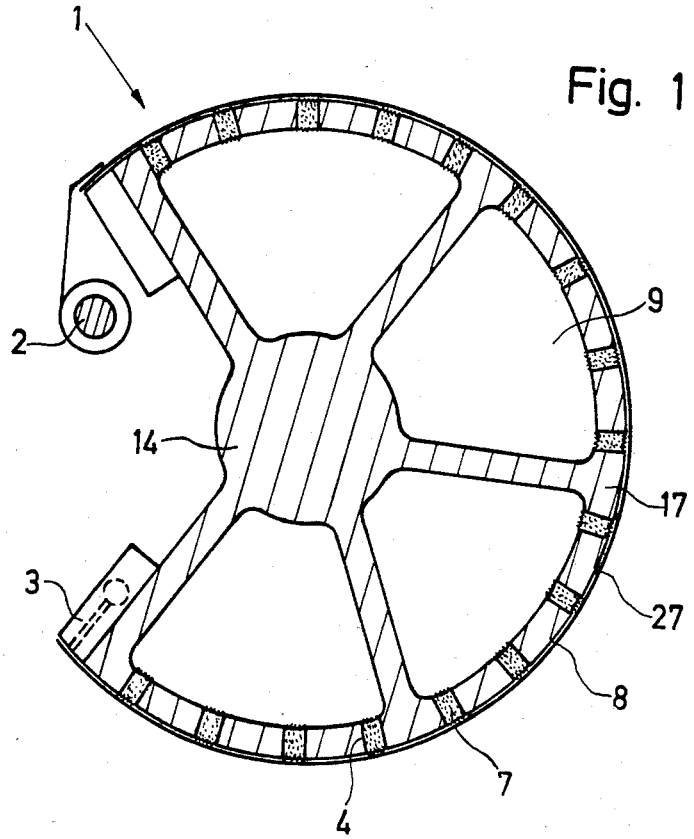
FIG. 1 is a diagrammatic cross-sectional view of a transfer cylinder according to the invention.

Referring now to the drawings and, first, particularly to FIG. 1 thereof, there is shown a peripheral or cylindrical surface of a transfer cylinder 1 constructed as a blowing air cylinder, with diagrammatically indicated sheet gripping devices 2 and 3, provided over the entire periphery of the cylinder 1 with blow holes 4 which can be formed in the casting during manufacture of the transfer cylinder 1 or subsequently formed therein mechanically, for example, by boring. The blow holes 4 are formed as through-bores and preferably distributed in uniform structure in the cylinder casing or jacket 17.

Figures 3, 4, 5, 6, 7, 8:
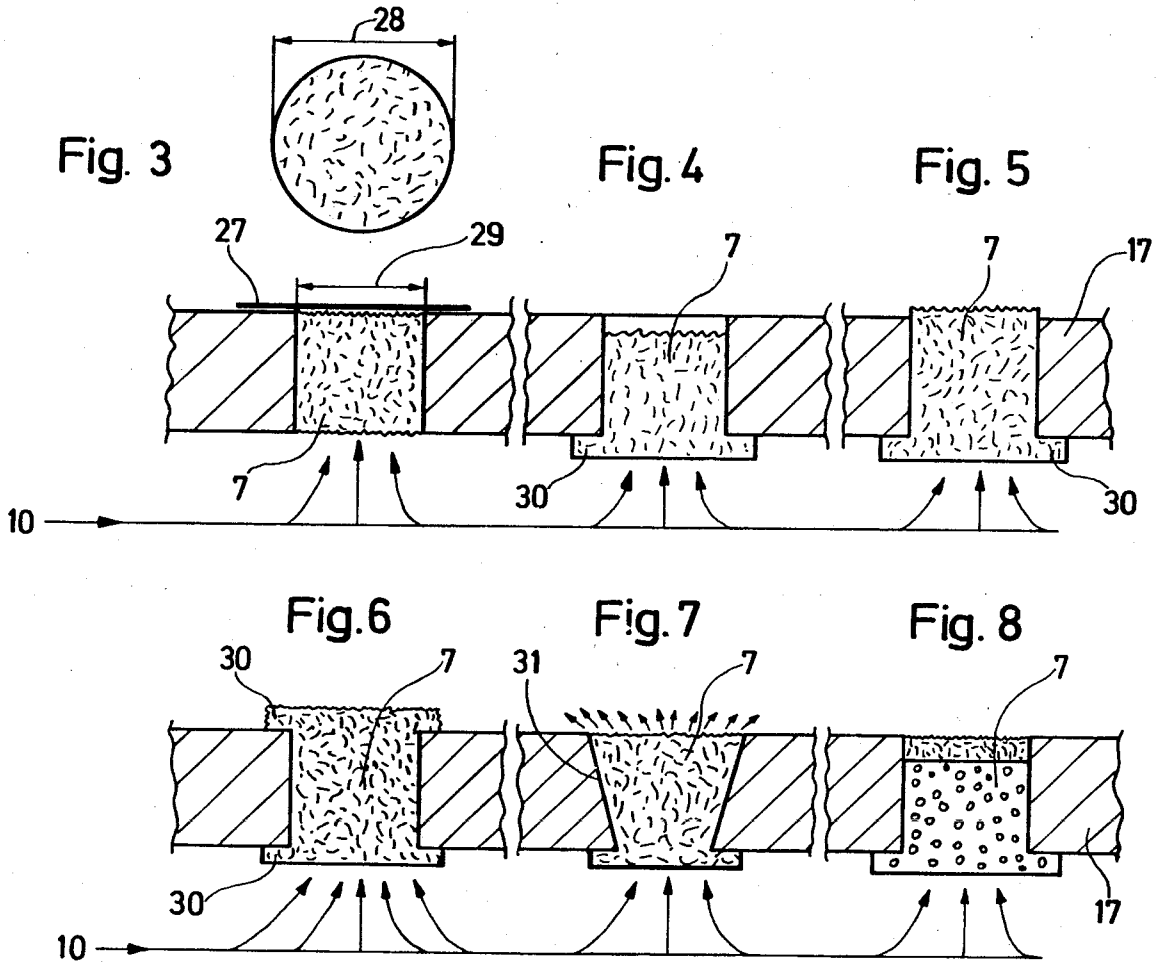
FIGS. 3 to 8 are enlarged fragmentary views of FIG. 2 showing different embodiments of air distribution elements forming part of the invention.

Air distribution elements 7 are disposed in the blow holes 4 and are formed of an air-permeable, elastic and relatively easily compressible material having a low specific gravity, preferably stamped or punched. A chemically hardened or consolidated textile and synthetic fleece, respectively, or a network of curled chemical fibers is used in the production process. It has been found to be advantageous to manufacture the air distribution element 7, as shown in FIG. 8, of a two-component, compound or composite material, the lower region thereof facing towards the interior of the cylinder 1 being formed of as much as possible of coarse pore and reversibly deformable foam material, and the upper region thereof facing towards the surface of the cylinder 1 being formed of one of the hereinaforementioned materials. Such two-component compound materials are known in the form of sponges and mats for industry and household cleaning purposes. Starting from the determination of the purpose for the air distribution element 7, it is advisably to employ, moreover, in the production process, a material which also has hydrophilic surface properties.

In order that the air distribution elements 7 have a fixed seat in the cylinder casing 17, the diameter 28 thereof is considerably greater than the diameter 28 of the blow holes 4 (FIG. 3). Due to the high degree of compressibility thereof, the air distribution elements 7, by relatively simple compression are easily inserted into the blow holes 4 wherein they are then retained primarily by being force-locked therein due to the elasticity tension thereof.

It has been found to be advantageous if the blow holes 4 are formed as coarse or rough bores in the cylinder casing 17. The network of fleece material and chemical fibers, respectively, with a multiplicity of very fine fiber parts can thus firmly clutch the rough inner surface of the blow holes 4 and thereby provides the air distribution elements 7 with an even more reliable hold in the cylinder casing 17 through form-locking reinforcement. In this regard, due to the conservation of cost-intensive fine working processes or operations, production costs are, moreover, reduced to a minimum.

Depending upon the type and physical properties of the material used for producing the air distribution elements 7, an additional form-locking support for the fixed seating thereof in the cylinder casing 17 can be applied. According to FIGS. 4 and 5, for this purpose, the air distribution elements 7 are provided, at the end thereof facing towards the interior of the cylinder 1, with a support collar 30 which, in the inserted condition of the air distribution elements 7, engages the inner edge of the cylinder 1 and, thereby, for example, can act oppositely to the centrifugal forces acting upon the air distribution elements 7 during rotation of the transfer cylinder 1. The same arrangement can result in a reverse manner also exclusively at the end of the air distribution elements 7 facing towards the surface of the cylinder 1, in order to act opposite to the higher compressive loading or tensile force of the sheet being transported, for example, at the withdrawal thereof from the transfer cylinder 1. Just as well, it is possible to provide the air distribution elements 7, as shown in FIG. 6 with support collars 30 at both ends thereof.

In order to increase the radius of operation of the blowing air discharging from the individual air distribution elements 7 and to effect an overlapping of the air discharging in all directions from the multiplicity of individual blow holes 4 with the air coming from the adjacent blow holes 4, the blow holes 4 according to FIG. 7 are formed with a conical winding 31 towards the surface of the cylinder 1, the appertaining air distribution elements 7 are constructed in equivalent form. In this embodiment, the inner support collar 30 or similar supporting measures have been found to be non-bargainable prerequisites for a fixed seating of the air distribution elements 7 in the cylinder casing 17.

In order that the homogenity of the surface of the cylinder 1 remain assured in essence and not unnecessarily interrupted by elevations or depressions, it is advantageous if the air distribution elements 7 are flushly terminated with surface of the cylinder 1 (FIGS. 3 and 8). Nevertheless, the longitudinal dimensional stability of the air distribution elements 7 in the production process is of secondary importance because the ends of the air distribution elements 7 projecting beyond the surface of the cylinder 1 can be exactly matched, in the inserted condition, directly to the curvature of the surface of the cylinder 1 by "shaving".

Through the use of a material with hydrophilic surface properties, the air distribution elements 7 can be constructed as sheet carriers and advantageously be permitted to project a defined distance beyond the surface of the cylinder 1, because in this case, the surface thereof has a smear-preventing effect. In no direct contact between the sheet to be conveyed and the surface of the air distribution elements 7 is desired, the length of the latter can be smaller than the thickness of the cylinder casing 17, so that the air distribution elements 7 are terminated while they are yet within the blow holes 4 and do not reach the surface of the cylinder 1 (FIG. 4).

Figure 2:
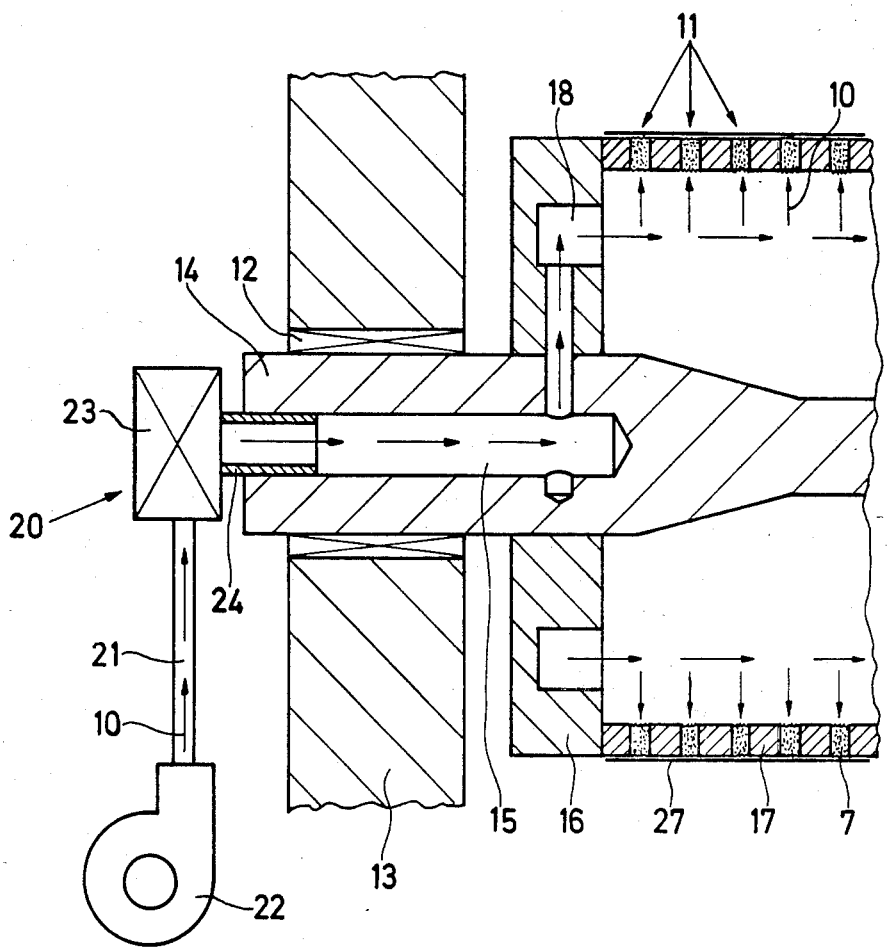
FIG. 2 is a fragmentary longitudinal sectional view of FIG. 1.

The basic construction of the transfer cylinder 1 is described hereinafter in greater detail with respect to FIG. 2, the path of the blowing air flowing through the transfer cylinder being represented by arrows 10.

In a bearing 12 of the side wall 13 located opposite the drive side of the printing machine, a cylinder bore 14 is mounted which is provided at the end thereof with a longitudinal blind bore 15. Inwardly of the side wall 13, an end-face disc 16 is fastened to the cylinder core 14, the cylinder casing or jacket 17 preferably formed as a casting being flanged in a conventional manner to the end-face disc 16. The end-face disc 16 is formed with an annular groove 18 on the side thereof facing towards the interior of the cylinder 1, the annular groove 18 being connected by a diametral blind bore 19 with the longitudinal blind bore 15 formed in the core 14.

The bore 15 formed in the cylinder core 14 is coupled with an air blower 22 by means of an air coupling 20 via a connecting line 21. The air coupling 20 is represented diagrammatically in FIG. 2 as a stationary coupling box or bushing 23 wherein there rotates a coupling sleeve 24 driven endwise into the borehole 15 formed in the core 14. The blowing air produced by the air blower 22 can consequently flow via the line system 21, the air coupling 20, the core bore 15, transverse blind bore 19 and the annular groove 18 into, respectively, the interior space of the transfer cylinder 1 and individual chambers 9 (FIG. 1 formed therein.

The mode of operation of the transfer cylinder 1 according to the invention is described hereinafter, it being noted with respect thereto that, depending upon the type, structure and shape of the material used for the air distributors 7, the latter can be employed without blowing air.

A freshly printed sheet 27 is taken over by the sheet gripping devices 2 and 3, for example, after the sheet 27 has been turned over in a perfector press, the take-over being such that the side of the sheet 27 remaining wet from printing faces downwardly towards the surface of the transfer cylinder 1. The sheet 27 does not come to lie directly on the surface of the cylinder 1, however, but rather, is uniformly supported and carried over the entire surface thereof by the air cushion emerging from the air distributors 7, so that any direct contact between ink, which is still wet from printing, and the surface of the cylinder 1 is excluded. Should any contact nevertheless occur to a slight extent, ink transfer from the sheet 27 to the sheet carriers 7 is rendered difficult, furthermore, due to the ink-repellant shape of the surface and the property of the material, respectively, of the sheet carriers 7.

As noted hereinbefore, the invention is not limited, of course, to the embodiments shown in the figures of the drawing and described in the foregoing specification. It is self-evident that numerous structural variations, for example, other shapes of the blow holes 4 and air distribution elements 7 or the choice of different materials for producing the air distribution elements 7 lie within the scope of the invention.

There are claimed:

1. Smear-free transfer cylinder for sheet-fed rotary printing machines have a cylindrical casing formed with blow holes distributed over the entire sheet-carrying peripheral surface of the cylinder, comprising air distribution elements respectively disposed in the blow holes for influencing blowing air flow out of the blow holes for forming a uniform air cushion, said air distribution elements being formed of air-permeable, elastic and slightly compressible material having a low specific gravity.

2. Smear-free transfer cylinder according to claim 1 wherein said air distribution elements are formed of at least one material selected from the group consisting of fleeces and synthetic fibers.

3. Smear-free transfer cylinder according to claim 1 wherein said air distribution elements are formed of two-component compound synthetic material having a lower region formed of reversibly deformable foam material and an upper region formed of a material selected from the group consisting of fleeces and synthetic fibers.

4. Smear-free transfer cylinder according to claim 1 wherein said air distribution elements are formed of hydrophilic material.

5. Smear-free transfer cylinder according to claim 1 wherein said air distribution elements are disposed in said blow holes in a positively locked manner.

6. Smear-free transfer cylinder according to claim 1 wherein said air distribution elements are disposed in said blow holes in an indirectly locked manner.

7. Smear-free transfer cylinder according to claim 1 wherein said air distribution elements have a respective diameter greater to such an extent than that of the respective blow holes so that said air distribution elements are retained in inserted condition in said blow holes.

8. Smear-free transfer cylinder according to claim 1, wherein said air distribution elements are formed at least at one end thereof with a supporting collar with which said air distribution elements are braced, in inserted condition thereof in said blow holes, at least against an inner edge of the cylinder.

9. Smear-free transfer cylinder according to claim 1 wherein both the blow holes and the air distribution elements appertaining thereto widen conically towards the surface of the cylinder.

10. Smear-free transfer cylinder according to claim 1 wherein said air distribution elements project maximally to the surface of the cylinder.

11. Smear-free transfer cylinder according to claim 1 wherein said air distribution elements project slightly beyond the surface of the cylinder.

* * * * *